US006793037B1

(12) United States Patent
Babuke et al.

(10) Patent No.: US 6,793,037 B1
(45) Date of Patent: Sep. 21, 2004

(54) STRUCTURED MOLDED PARTS FOR SOUND ABSORPTION

(75) Inventors: Gerhard Babuke, Weil der Stadt (DE); Philip Leistner, Stuttgart (DE); Helmut Fuchs, Weil (DE); Xueqin Zha, Boeblingen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 09/868,317

(22) PCT Filed: Dec. 15, 1999

(86) PCT No.: PCT/EP99/09969

§ 371 (c)(1),
(2), (4) Date: Sep. 13, 2001

(87) PCT Pub. No.: WO00/36240

PCT Pub. Date: Jun. 22, 2000

(30) Foreign Application Priority Data

Dec. 17, 1998 (DE) ..... 198 61 016

(51) Int. Cl.[7] ..... E04B 1/82

(52) U.S. Cl. ..... 181/293; 181/284; 181/286; 342/1; 342/4

(58) Field of Search ..... 181/284–296; 342/1, 4

(56) References Cited

U.S. PATENT DOCUMENTS

| | | | | | |
|---|---|---|---|---|---|
| 3,712,413 | A | * | 1/1973 | Eckel | 181/295 |
| 5,160,816 | A | | 11/1992 | Chlop | |
| 5,665,943 | A | * | 9/1997 | D'Antonio | 181/295 |
| 5,780,785 | A | * | 7/1998 | Eckel | 181/295 |
| 5,892,188 | A | * | 4/1999 | Hayashi et al. | |
| 6,035,965 | A | * | 3/2000 | Fujiwara et al. | 181/293 |
| 6,373,425 | B1 | * | 4/2002 | Inoue et al. | |

FOREIGN PATENT DOCUMENTS

| | | |
|---|---|---|
| FR | 2298848 | 8/1976 |
| GB | 810505 | 3/1959 |

* cited by examiner

*Primary Examiner*—David Martin
*Assistant Examiner*—Renata McCloud
(74) *Attorney, Agent, or Firm*—Crowell & Moring LLP.

(57) ABSTRACT

Structured pre-form bodies as panel lining for wide-band sound absorption are made of an open-cell foam material having a rigid framework co-vibrating in a resonant manner at low frequencies. The pre-form bodies have a base layer and a columnar structure positioned directly in front of or on the base layer. The columnar structure has a non-symmetrical distribution of height and cross-section, thereby forming a wide-band tuned moderator gap and the columnar height corresponds approximately to the density of the base layer. The columnar structure has a framework resonance adjustable as a function of parameters of the base layer.

10 Claims, 5 Drawing Sheets

STRUCTURED MOLDED PARTS FOR SOUND ABSORPTION

BACKGROUND AND SUMMARY OF INVENTION

The present invention relates to structure pre-form bodies consisting of open-cell foamed material presenting a comparatively solid framework co-vibrating in a resonant manner at low frequencies as panel lining for wide-band sound absorption.

Structured sound-absorbing panel linings are known for the application in acoustic free-field spaces, which consist of a porous material and present substantially a wedge-shaped or pyramidal geometry [1, 2, 3, 4]. This outside geometry is realized with both compact shaped or pre-formed bodies [1, 2, 3] and also with layers or other element assemblies [4].

The acoustic classification [1] of these panel linings is mainly determined by a frequency-independent high degree of absorption at an orthogonal incidence of sound. The lower critical or limit frequency, from which onwards this high absorption level is reached, is of particular importance because it is decisive for the total thickness of the panel lining. Conventionally structured linings are governed by the relationship that the lining thickness corresponds roughly to one quarter of the wavelength of the lower limit frequency when a 99% degree of absorption is required. This furnishes a lining thickness of roughly 0.85 meters at a lower limit frequency of 100 Hz. In view of this magnitude it becomes evident that a reduction of the lining by roughly 40% saves not only some volume of the structure but also enlarges the measuring radius in the space [5] with an unvaried high degree of absorption.

The present invention is based on the problem of designing the pre-form bodies according to prior art in a way that the structural depth may be made smaller while the acoustic characteristics are retained at a constant level.

This problem is solved by the pre-form bodies according to the present invention.

The pre-form bodies consist of a plane base layer of a defined thickness on the side of the wall as well as a columnar structure positioned directly in front of the base layer and having a defined distribution of height and cross-section in the manner of a wide-band tuned moderator gap. The maximum columnar height corresponds expediently to the thickness of the base and the columns have a one-side bevel cut on a room side whilst the moderator gap has a one-side bevel cut on its base side.

DETAILED DESCRIPTION OF THE DRAWINGS

The pre-form bodies according to the present invention consist of an open-cell foamed material presenting a comparatively solid framework co-vibrating in a resonant manner at low frequencies, such as the cellular melamine resin known by the trademark BASOTECT®. The sound absorption by this material is defined, on the one hand, by its porosity, i.e., by the conversion of sound energy into thermal energy due to friction. On the other hand, the comparatively rigid framework surrounding the open cells creates the effect of an acoustic mass whose movement or deformation, respectively, represents a further resonance-like mechanism of absorption. This resonance distinctly increases the absorption at low frequencies, with the resonance frequency being shifted farther towards low frequencies as the thickness of the layer increases.

Figure 1:
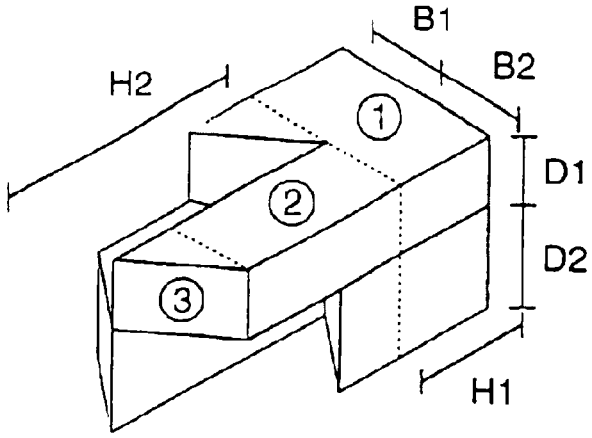
FIG. 1: structure of the inventive pre-form bodies consisting of the base layer (1) and the column array (2) with an bevel cut (3) on the room side.
Figure 9:
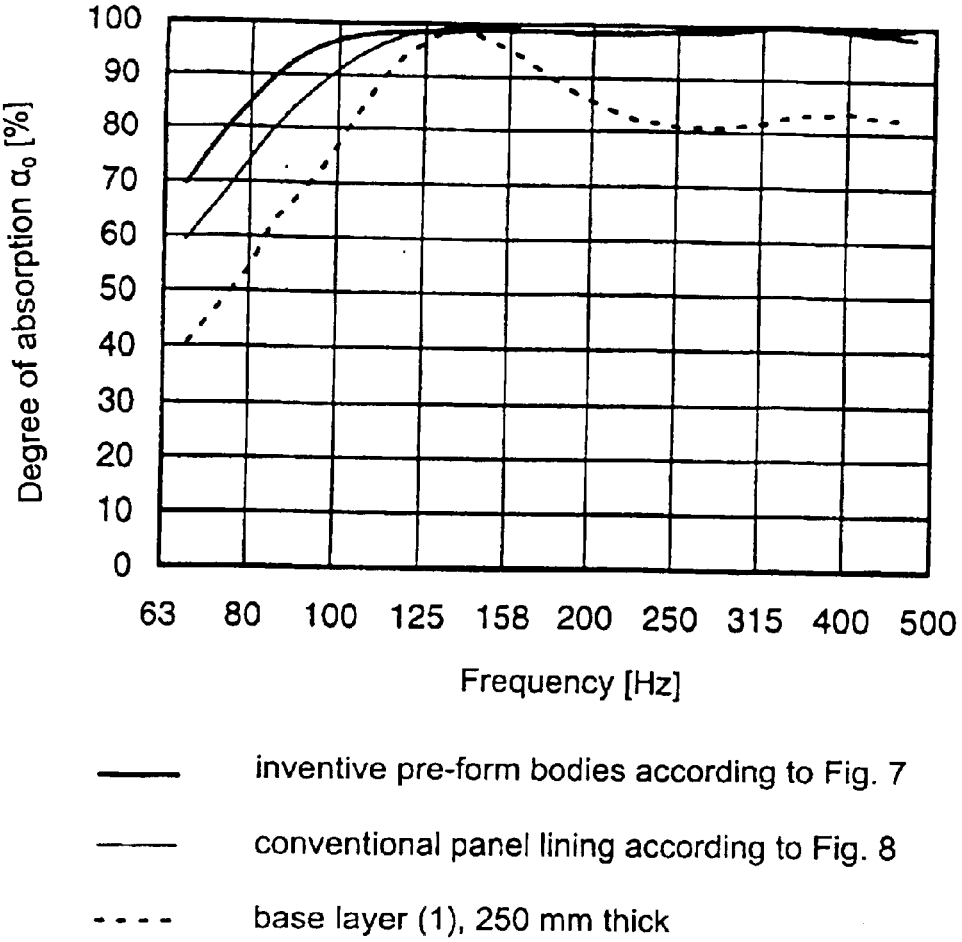
FIG. 9: contrastive comparison of the measured degrees of absorption for an orthogonal sound incidence of the inventive pre-form bodies according to FIG. 7 against a conventional panel lining according to FIG. 8.

The starting point of the inventive pre-form bodies is therefore a plane base layer (1) having the thickness H1 (between 200 and 500 mm, preferably 250 mm) and made of such a cellular material as is illustrated in FIG. 1, which, in distinction from layers of foamed material producing negligible framework vibrations at low frequencies and having a degree of absorption of almost 1. A BASOTECT® panel, 150 mm thick, may be mentioned as an example, which absorbs already 99% of the orthogonally incident sounds energy at roughly 125 Hz (FIG. 9).

Figure 2:
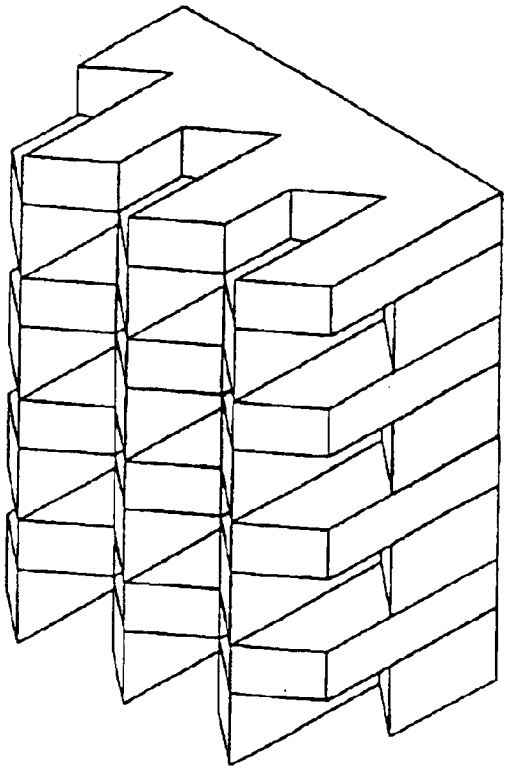
FIG. 2: exemplary combination of the inventive pre-form bodies to form a large-side panel lining.

In the range of medium and high frequencies, the sound absorption is due to the sound impedance in combination with the thickness of the cellular material. Depending on the thickness of the layer, however, a range of up to 15% reduction in sound absorption occurs between these two high-absorption frequency ranges. To balance this reduction a tuned array of columns (2) of cellular material in front of the base layer (1) is joined in the inventive pre-form bodies. At a defined length H2 (in the order of H1) and with square cross-sectional areas (D1, D2, B1, B2 according to FIG. 1 between 50 and 200 mm so that D1+D2 and B1+B2 produce preferably 250 mm), these columns define square hollow chambers in the manner of moderator gaps (FIG. 2) which terminate, on one side, at the base layer (1) and open into the space on the other side.

Figure 3:
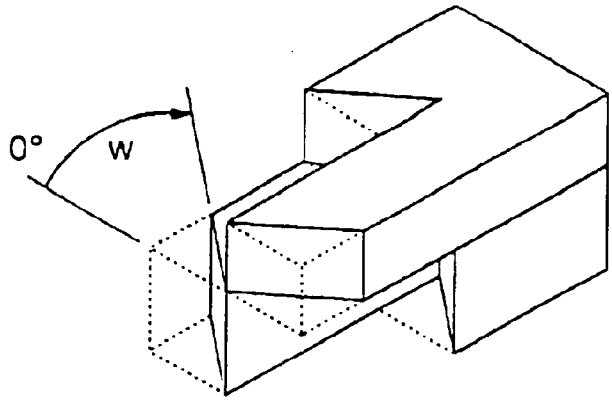
FIG. 3: structure of the inventive pre-form bodies with the angle w of the one-side bevel cut (3)

The dimensioning of this moderator gap is oriented by the frequency range within which the base layer (1) alone presents an insufficient sound absorption characteristic. Essential design parameters for the moderator gap are its length and the thickness of the lateral attenuation layer. In the exemplary BASOTECT® panel, 250 mm thick, a column height of roughly 250 mm and a column cross-section of approximately 125 mm×125 mm has been found to be a suitable column geometry. The further optimization of the inventive pre-form bodies encompasses, expresses verbis, different or varying cross-sections of the columns and hence a non-symmetrical design of the moderator gap. The columns of cellular material present a one-side bevel cut (3) at the room-side end so as to avoid an abrupt impedance transition on the surface of the lining. The cutting angle (w) according to FIG. 3 amounts to roughly 35°, relative to the plane of the wall. For the same reason, the moderator gaps terminate on the base side equally in the afore-described cut, rather than in a plane form.

Figure 4:
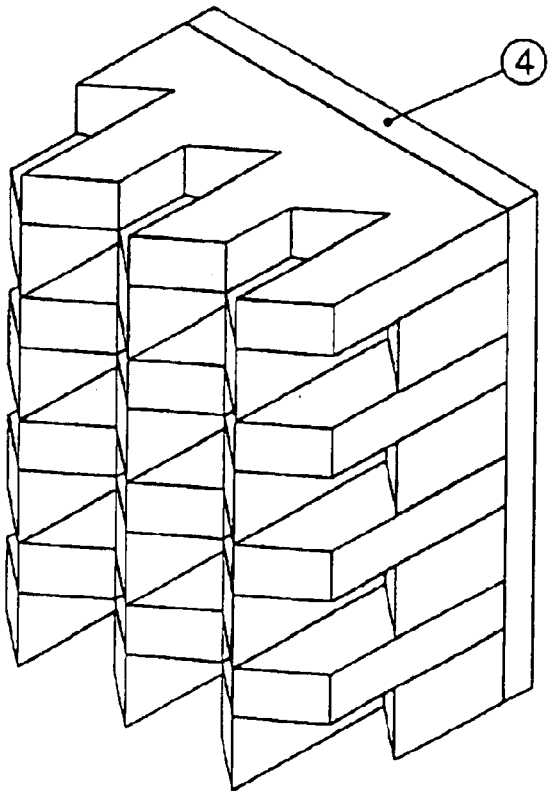
FIG. 4: combination of the inventive pre-form bodies with a composite panel resonator (4)
Figure 5:
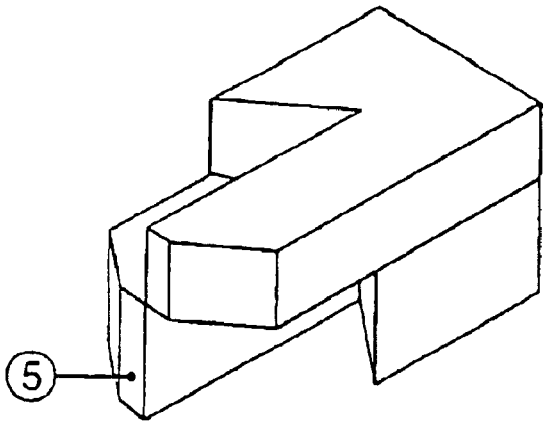
FIG. 5: structure of the inventive pre-form bodies with the flattening (5) on the room side of the array of columns (2) presenting a one-side bevel cut.
Figure 6:
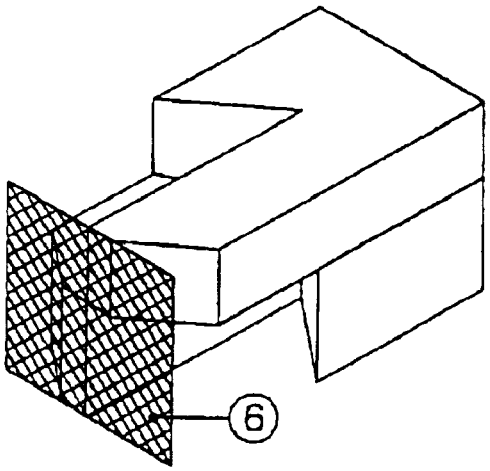
FIG. 6: structure of the inventive pre-form bodies with the protective cover (6) on the room side.

An embodiment of the inventive pre-form bodies consists in their combination with a composite panel resonator (4) [6] which is employed also in plane sound-absorbing panel linings [7] for extending the frequency range of high sound absorption towards the low frequencies. In the case of a combination with the inventive pre-form bodies, the base layer (1) is connected to the vibrating metal sheet of the composite panel resonator (FIG. 4) on its rear side, e.g., by means of adhesive bonding. Further practical embodiments of the inventive pre-form bodies are acoustically transmissive covers (6) made of non-woven or woven material or perforated panel material for mechanical protection of the lining (FIG. 5). The acoustically almost inefficient flattening (5) by up to 30 mm on the bevel cuts (3) on the room side, which is illustrated in FIG. 6, is provided to this end in order to ensure a partially plane support of large-side cages made of perforated panels.

The advantages of the inventive pre-form bodies over existing structured panel linings for sound absorption relate to the following features:

For a specified lower limit frequency, from which onwards a degree of sounds absorption as high as possible must be achieved, a distinctly smaller structural depth (roughly 40%) is sufficient for the inventive pre-form bodies.

As a result of the rigid framework of cellular material, of the concurrent low weight of unit volume (10 kg/m$^2$) and the small structural depth (of roughly 500 mm), the inventive pre-form bodies are inherently stable or self-supporting and do not require any holding structure. An adhesive bond on the rear side for attachment to the wall of the room is sufficient for fastening, for instance.

The acoustically almost inefficient flattening (5) of the bevel cuts on the room side assists the use of covers (6), e.g., with perforated panels, so that a plane lining surface is created that is protected on the side of the room.

Anti-trickle protection, as it is required, for instance, for panel linings consisting of a fibrous material, is not required.

There are numerous possibilities of optimizing the production of the inventive pre-form bodies because the fibre-free material is, on the one hand, suitable for prefabrication with optional dimensions and, on the other hand, easy to mount.

Figure 10:
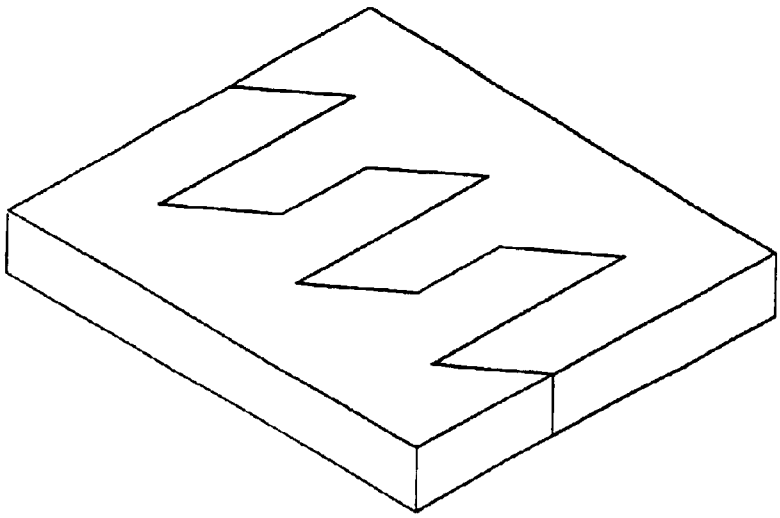
FIG. 10: illustration of the waste-free cutting of the inventive pre-form bodies.

The inventive pre-form bodies are cut from the typical blanks (blocks of cellular material with a size of 1.25 m×1 m×2.5 m or panels with an area of 1.25 m×1 m) in a way that cuttings or waste will not be products, as is illustrated in FIG. 10.

Figure 7:
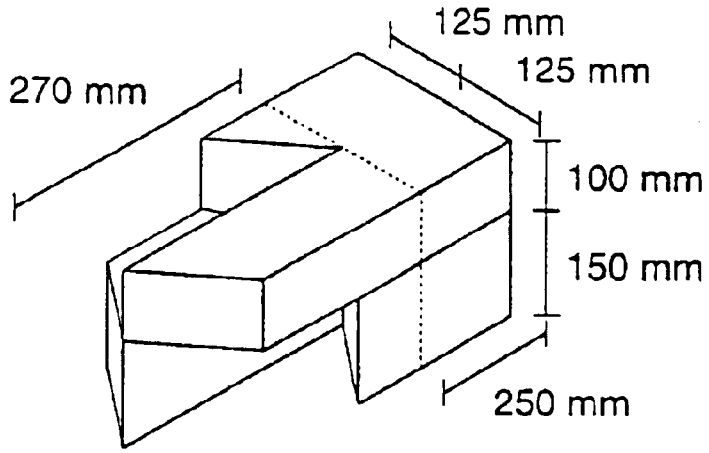
FIG. 7: exemplary inventive pre-form bodies (total thickness 520 mm)
Figure 8:
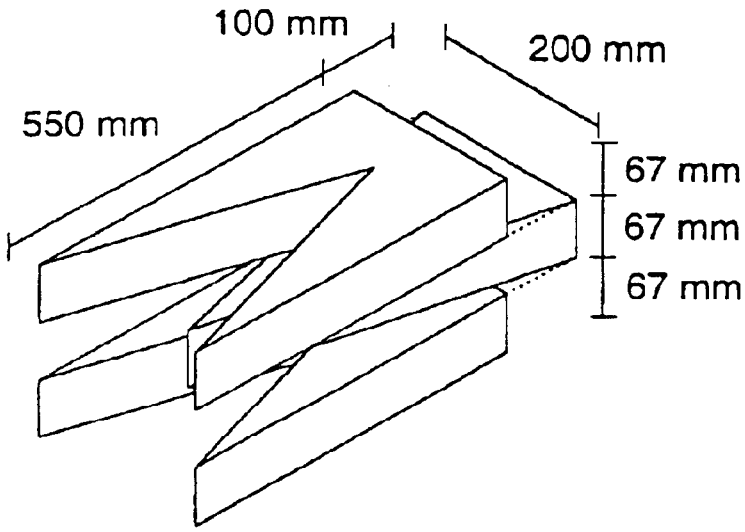
FIG. 8: exemplary conventional panel lining consisting of mineral-wool panels (total thickness 650 mm)

An exemplary comparison of the inventive pre-form bodies (FIG. 7) against conventional structured wall absorbers (FIG. 8) renders the savings in structural depth with a simultaneously increased measured sound absorption (FIG. 9) even more evident, particularly at low frequencies.

Literature

[1] DIN Standard 45635, Part 1, Annex B 1.2

[2] N.N.: "Reflexionsarme Schallmessräume für Forschung" [*Low-reflection sound-measuring spaces for application sin industry and research*] (company pamphlet), G+H Montage GmbH, 1992

[3] U.S. Pat. No. 5,780,785, Acoustic absorption device and an assembly of such device

[4] Rother, P.; Nutsch, Jr. "Prinzip und Andwendung einer neuartigen Wandverkleidung für reflexionsarme Räume" [*Principle and application of a novel panel lining for low-reflection spaces*], 4$^{th}$ Intern. Congress on Acoustics (ICA), Copenhagen 1962, page M44.

[5] Babuke, G.; Fuchs, H. V.; Teige, K.; Pfeiffer, G.: "Kompakte reflexionsarme Auskleidung für kleine Messr äume" [*Compact low-reflection lining for small measuring spaces*], in: Bauphysik 20 (1998), No. 5, pages 157–165.

[6] German Patent No. DE 19506511, Composite panel resonator

[7] German Patent DE 19738757, Low-reflection room lining for the entire audible range.

What is claimed is:

1. Structured pre-form bodies forming a panel lining adapted to be mounted on a wall in a room for wide-band sound absorption, each of said structured pre-form bodies comprising:

a base layer; and columns positioned directly in front of or on the base layer in arrays, each column array having no symmetry, wherein the structured pre-form bodies define wide-band tuned moderator gaps, wherein a column height corresponds approximately to the thickness of said base layer, wherein the structured pre-form bodies comprise open-cell foam material having a rigid framework co-vibrating in a resonant manner at low frequencies, wherein each column in each of said structured pre-form bodies has a one-side bevel cut on a side of the column adapted to face the room, and wherein each moderator gap has a one-side bevel cut on its base side.

2. Structured pre-form bodies according to claim 1, wherein at least part of said open-cell foam material comprises a melamine resin.

3. Structured pre-form bodies according to claim 1, wherein bevel cuts on the sides of the columns adapted to face the room are configured to alternate in at least one of a vertical or a horizontal direction.

4. Structured pre-form bodies according to claim 1, wherein said bevel cut on the side of the column adapted to face the room is shortened and flattened by up to 30 mm.

5. Structured pre-form bodies according to claim 1, wherein said bevel cut on the side of the column adapted to face the room has an angle of roughly 35° relative to a plane of a wall.

6. Structured pre-form bodies according to claim 1, further comprising an acoustically transmissive cover made of non-woven or woven material or soft cellular material supported on a plane of said bevel cut on the side of the column adapted to face the room.

7. Structured pre-form bodies according to claim 1, further comprising perforated panels in front of said pre-form bodies for mechanical protection, which are fastened to a wall by spacers.

8. Structured pre-form bodies according to claim 1, wherein said pre-form bodies are self-supporting due to at least one of their material or shape.

9. Structured pre-form bodies according to claim 1, wherein said base layer is fastened on a rear side to vibrating metal sheets of a composite panel resonator by an adhesive bond, with a lateral spacing of roughly 200 mm being provided between said vibrating metal sheets.

10. A panel lining comprising the structured pre-form bodies according to claim 1.

* * * * *